US010781983B2

(12) United States Patent
Yeh

(10) Patent No.: US 10,781,983 B2
(45) Date of Patent: Sep. 22, 2020

(54) COURTYARD SENSOR LAMP

(71) Applicant: ZHONGSHAN LITES "R" US CO., LTD., Zhongshan (CN)

(72) Inventor: Lu-Sung Yeh, Zhongshan (CN)

(73) Assignee: ZHONGSHAN LITES "R" US CO., LTD., Zhongshan (CN)

( * ) Notice: Subject to any disclaimer, the term of this patent is extended or adjusted under 35 U.S.C. 154(b) by 0 days.

(21) Appl. No.: 16/313,210

(22) PCT Filed: Feb. 5, 2018

(86) PCT No.: PCT/CN2018/075298

§ 371 (c)(1),
(2) Date: Dec. 26, 2018

(87) PCT Pub. No.: WO2018/145616

PCT Pub. Date: Aug. 16, 2018

(65) Prior Publication Data

US 2019/0170308 A1 Jun. 6, 2019

(30) Foreign Application Priority Data

Feb. 7, 2017 (CN) ..... 2017 2 0112594 U

(51) Int. Cl.
*F21V 15/00* (2015.01)
*F21S 8/00* (2006.01)
(Continued)

(52) U.S. Cl.
CPC ..... *F21S 8/00* (2013.01); *F21V 15/01* (2013.01); *F21V 17/10* (2013.01); *F21V 23/04* (2013.01);
(Continued)

(58) Field of Classification Search
CPC ..... F21V 21/10; F21V 21/108; F21V 21/14; F21V 21/116; F21V 21/12; F21V 21/30; F21V 23/04; F21W 2131/109
(Continued)

(56) References Cited

U.S. PATENT DOCUMENTS 2,246,961 A * 6/1941 Voogt ..... F21V 23/04 200/17 R
2,278,218 A * 3/1942 Ruggieri ..... F21V 21/108 362/437
(Continued)

FOREIGN PATENT DOCUMENTS

CN 2839804 Y 11/2006
CN 204756603 U 11/2015
(Continued)

OTHER PUBLICATIONS

International Search Report Application No. PCT/CN2018/075298 dated Apr. 28, 2018.

*Primary Examiner* — Matthew J. Peerce
(74) *Attorney, Agent, or Firm* — Miller, Matthias & Hull LLP

(57) ABSTRACT

A courtyard sensor lamp suitable for use in a courtyard is disclosed, including an arm, a cover, and a lampshade (31). The arm includes a fixing end (11) and a hanging end (12) connected to each other. The cover is fixedly suspended from the hanging end (12), and includes an upper cover (21) and a lower cover (23) which can axially rotate relative to each other, and a connection portion (22) connected to the upper cover (21) or the lower cover (23). A switch module (24) is fixed to the upper portion of the lower cover (23) and disposed in the connection portion (22). The connection portion (22) is provided with a through hole (25) corresponding to the switch module (24). The lampshade (31) is fixed below the lower cover (23). A light source (32) is
(Continued)

disposed in the lampshade (31). The light source (32) is electrically connected to the switch module (24). The axial rotation between the upper cover (21) and the lower cover (23) rotates the switch module (24) accordingly to a use position or a hidden position. The switch module (24) is hidden, and thus the appearance is good, and the switch module (24) is prevented from being exposed to sunlight or rain.

9 Claims, 7 Drawing Sheets

(51) Int. Cl.

| | |
|---|---|
| ***F21V 15/01*** | (2006.01) |
| ***F21V 23/04*** | (2006.01) |
| ***F21V 31/00*** | (2006.01) |
| ***F21V 17/10*** | (2006.01) |
| *F21Y 115/10* | (2016.01) |

(52) U.S. Cl.
CPC ..... *F21V 23/0442* (2013.01); *F21V 31/00* (2013.01); *F21Y 2115/10* (2016.08)

(58) Field of Classification Search
USPC ..... 362/362
See application file for complete search history.

(56) References Cited

U.S. PATENT DOCUMENTS

| | | | | |
|---|---|---|---|---|
| 2,878,373 | A * | 3/1959 | Bramming | F21V 23/04 362/395 |
| 3,264,465 | A * | 8/1966 | Rex | F21V 23/00 250/215 |
| 8,434,894 | B2 * | 5/2013 | Workman | F21S 2/00 362/249.01 |
| 2003/0053312 | A1 | 3/2003 | Hung | |
| 2005/0200495 | A1 * | 9/2005 | Sibalich | F21S 8/02 340/693.11 |
| 2008/0278937 | A1 * | 11/2008 | Bono | F21L 4/005 362/205 |
| 2016/0195235 | A1 * | 7/2016 | Workman | F21V 1/08 362/280 |
| 2017/0171932 | A1 * | 6/2017 | Puvanakijjakorn | F21V 17/101 |
| 2017/0175996 | A1 * | 6/2017 | Chien | F21S 8/035 |
| 2017/0307192 | A1 * | 10/2017 | LaFemina | F21V 21/108 |
| 2018/0038583 | A1 * | 2/2018 | Shi | F21V 29/77 |
| 2018/0128435 | A1 * | 5/2018 | Workman | F21V 7/28 |

FOREIGN PATENT DOCUMENTS

| | | | |
|---|---|---|---|
| CN | 105135270 | A | 12/2015 |
| CN | 205746424 | U | 11/2016 |
| CN | 206530929 | U | 9/2017 |

* cited by examiner

COURTYARD SENSOR LAMP

CROSS-REFERENCE TO RELATED APPLICATION

This patent application is a 35 USC § 371 U.S. national stage of International Application No. PCT/CN2018/075298 filed on Feb. 5, 2018, and claims priority under the Paris Convention to Chinese Patent Application Serial No. CN 201720112594.4 filed on Feb. 7, 2017.

TECHNICAL FIELD

The present disclosure belongs to the technical field of illumination, and more particularly, to a courtyard sensor lamp with a built-in sensor, which is suitable for use in a courtyard.

BACKGROUND

In the field of illumination, a lamp, known as "courtyard sensor lamp" is used for lighting in the interior of the courtyard. There are many kinds of courtyard sensor lamps, such as a courtyard sensor lamp fixed in a courtyard or a flower bed by an upright rod, or a courtyard sensor lamp directly attached to a wall.

In terms of energy saving and environmental protection, the courtyard sensor lamps used in a house or in a yard is generally controlled to be turned on or turned off separately. That is, it is turned on when needed, and turned off when not needed. Therefore, each courtyard sensor lamp is provided with a switch module which is separately controllable. However, the courtyard sensor lamp is generally in a relatively empty environment (such as road side, flower bed side, or outdoor wall), and a simple external switch module may not only affect the aesthetics of the courtyard sensor lamp, but also have a reduced service life due to a large amount of water flowing into the switch module or light shining directly on the switch module.

For most of the courtyard sensor lamps, the sensor is separable from the switch control module, which is inconvenient for consumers to use and affects the appearance and shape of the lamp body.

Therefore, based on the above deficiencies, there is an urgent need in the market to provide a courtyard sensor lamp that is aesthetically pleasing, easy to use, and safe to use.

SUMMARY

Based on the above, in order to overcome the deficiencies in the prior art, the present disclosure provides a courtyard sensor lamp which is aesthetically pleasing, convenient to use, and safe to use.

The technical solution is as follows: a courtyard sensor lamp, which includes a arm, a cover, a light source and a lampshade.

The arm has a fixed end and a hanging end connected to each other.

The cover includes an upper cover, a lower cover, a connecting portion and a switch module, the upper cover is connected to the hanging end, the upper cover is rotatably connected to the lower cover, the connecting portion is connected to the upper cover or the lower cover, the connecting portion is provided with a through hole corresponding to the switch module, and the switch module is fixed to a upper portion of the lower cover and disposed in the connecting portion.

A light source is electrically connected to the switch module.

The lampshade is fixed below the lower cover and covers the light source.

The switch module is an integrated lamp sensor and sensor switch control module, and the switch module is controllable by rotation between the upper cover and the lower cover. During an operating mode, the lamp sensor faces toward the front of the courtyard sensor lamp. By rotating the upper cover or lower cover, a control button on the back of the lamp sensor can be showed. When adjustment of the lamp sensor is finished, the lamp sensor is rotated back to an original position, and then the courtyard sensor lamp can operates normally.

With the rotation between the upper cover and the lower cover, the switch module can be rotated accordingly to a use position or a hidden position. The switch module is hidden to achieve an aesthetically pleasing appearance, and also prevents the switch module from being exposed to the outside environment and being irradiated by sunlight or eroded by wind or rain.

In one embodiment, the connecting portion and the lower cover are fixed to each other, a lower portion of the upper cover is provided with an annular undulating protrusion, and an upper portion of the connecting portion is provided with a groove engaged with the undulating protrusion. The groove is an annular groove cooperating with the annular undulating protrusion. There is an interference fit between the undulating projection and the groove.

In one embodiment, there is at least two undulating projections and at least two grooves engaged with the at least two undulating projections respectively. A plurality of undulating projections make the structure more compact and the fit more stable.

In one embodiment, the connecting portion and the upper cover are fixed to each other, a lower portion of the connecting portion is provided with a concave step, and the lower cover or the switch module fixed on the lower cover is provided with a boss cooperating with the step. The lower cover is connected to the connecting portion by an engaging manner. The lower cover is covered in the connecting portion, and the switch module disposed in the lower cover is also covered and hidden by the switch module to prevent the switch module from being exposed to the outside environment and being irradiated by sunlight or eroded by wind or rain. By rotating the switch module to the corresponding through hole of the connecting portion, the switch control of the courtyard sensor lamp can be implemented. Such operation is convenient and simple.

In one embodiment, an angle of axial rotation between the upper cover and the lower cover is $75° \leq \alpha \leq 175°$. When the angle is less than 75°, the rotation angle is too small, and the control is inconvenient; and when the angle is greater than 175°, the corresponding through hole of the connecting portion is opened larger, and the larger the through hole, the more rain or light entering during the rain or the sun, thereby affecting the service life. Moreover, the larger through hole also affects the aesthetics of the appearance.

In one embodiment, the through hole has a long groove shape formed along the rotation angle. The through hole is also a rotation track of the switch module.

In one embodiment, the light source is an incandescent lamp or an LED lamp.

In one embodiment, the light source is fixed inside the lampshade at an upper part of the lampshade by a ceramic lamp holder. The ceramic lamp holder and the switch module are connected to each other, and the switch module is connected to the electric supply.

In one embodiment, the switch module includes an infrared sensor and a switch knob electrically connected to each other.

In one embodiment, a sealing element is disposed between the upper cover, the connecting portion and the lower cover. The sealing element is a silicone seal.

The principles and effects of the present disclosure will be further described below in conjunction with the above technical solutions.

1. With the axial rotation between the upper cover and the lower cover, the switch module can be rotated to the use position or the hidden position accordingly. The switch module is hidden to achieve an aesthetically pleasing appearance, and also prevents the switch module from being exposed to the outside environment and being eroded by the sunlight, wind or rain.

2. The lower portion of the upper cover is provided with an annular undulating protrusion, and the upper portion of the connecting portion is provided with a groove engaged with the undulating protrusion. The groove is an annular groove cooperates with the annular undulating protrusion. There is an interference fit between the undulating projection and the groove. The rotational configuration is simple, and easy to operate.

3. The connecting portion and the upper cover are fixed to each other, the lower portion of the connecting portion is provided with a concave step, and the lower cover or the switch module fixed on the lower cover is provided with a boss cooperating with the step. The lower cover is connected to the connecting portion by the engaging manner, the lower cover is covered in the connecting portion, and the switch module disposed in the lower cover is also covered and hidden by the switch module to prevent the switch module from being exposed to the outside environment and being irradiated by sunlight or eroded by wind or rain. By rotating the switch module to the corresponding through hole of the connecting portion, the switch control of the courtyard sensor lamp can be implemented. Such operation is convenient and simple.

DESCRIPTION OF THE REFERENCE SIGNS

11, fixed end; 12, hanging end; 21, upper cover; 22, connecting portion; 23, lower cover; 24, switch module; 25, through hole; 241, switch knob; 211, undulating protrusion; 221, groove; 31, lampshade; 32, light source; and 33, ceramic lamp holder.

DETAILED DESCRIPTION OF THE PREFERRED EMBODIMENT

The embodiments of the present disclosure are described in detail below.

A courtyard sensor lamp according to the present disclosure includes an arm, a cover, a light source 32 and a lampshade 31.

Figure 1:
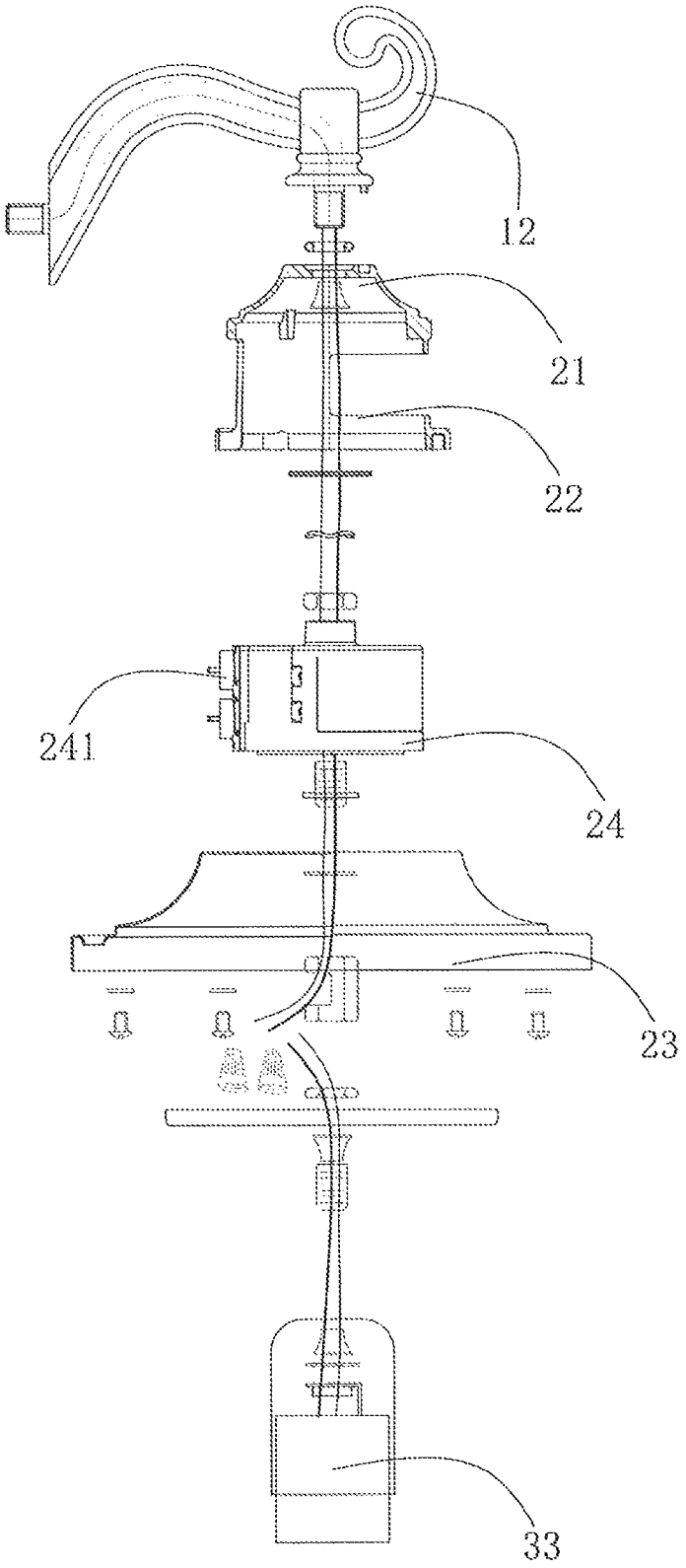
FIG. 1 is a schematic structural diagram illustrating a courtyard sensor lamp according to an embodiment of the present disclosure.
Figure 2:
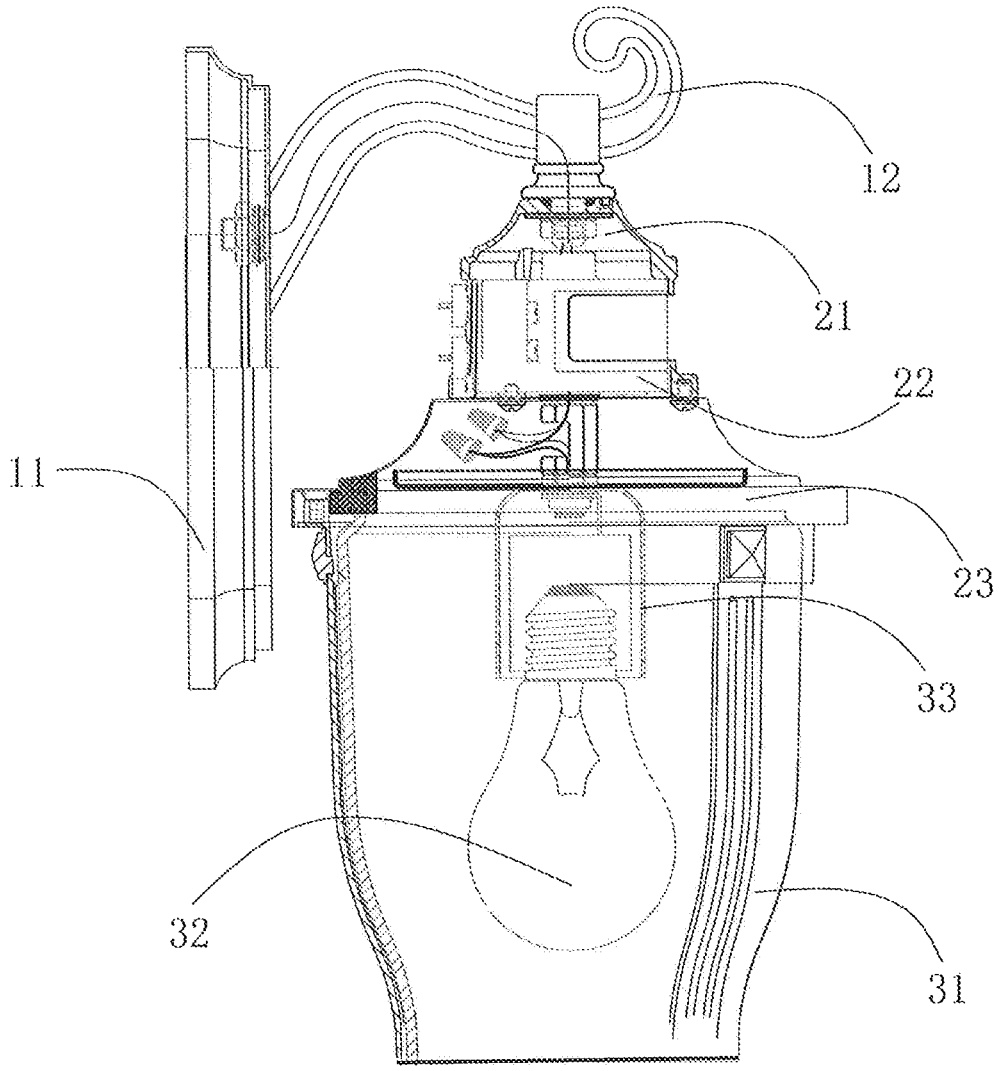
FIG. 2 is another schematic structural diagram illustrating a courtyard sensor lamp according to an embodiment of the present disclosure.

As shown in FIG. 1 and FIG. 2, the arm has a fixed end 11 and a hanging end 12 connected to each other. The fixed end 11 and the hanging end 12 may be integrally formed, or may be separate components that connected to each other. The fixed end 11 is provided with a screw hole for being fixed to the wall, and the hanging end 12 extends outward by a certain distance.

Figure 3:
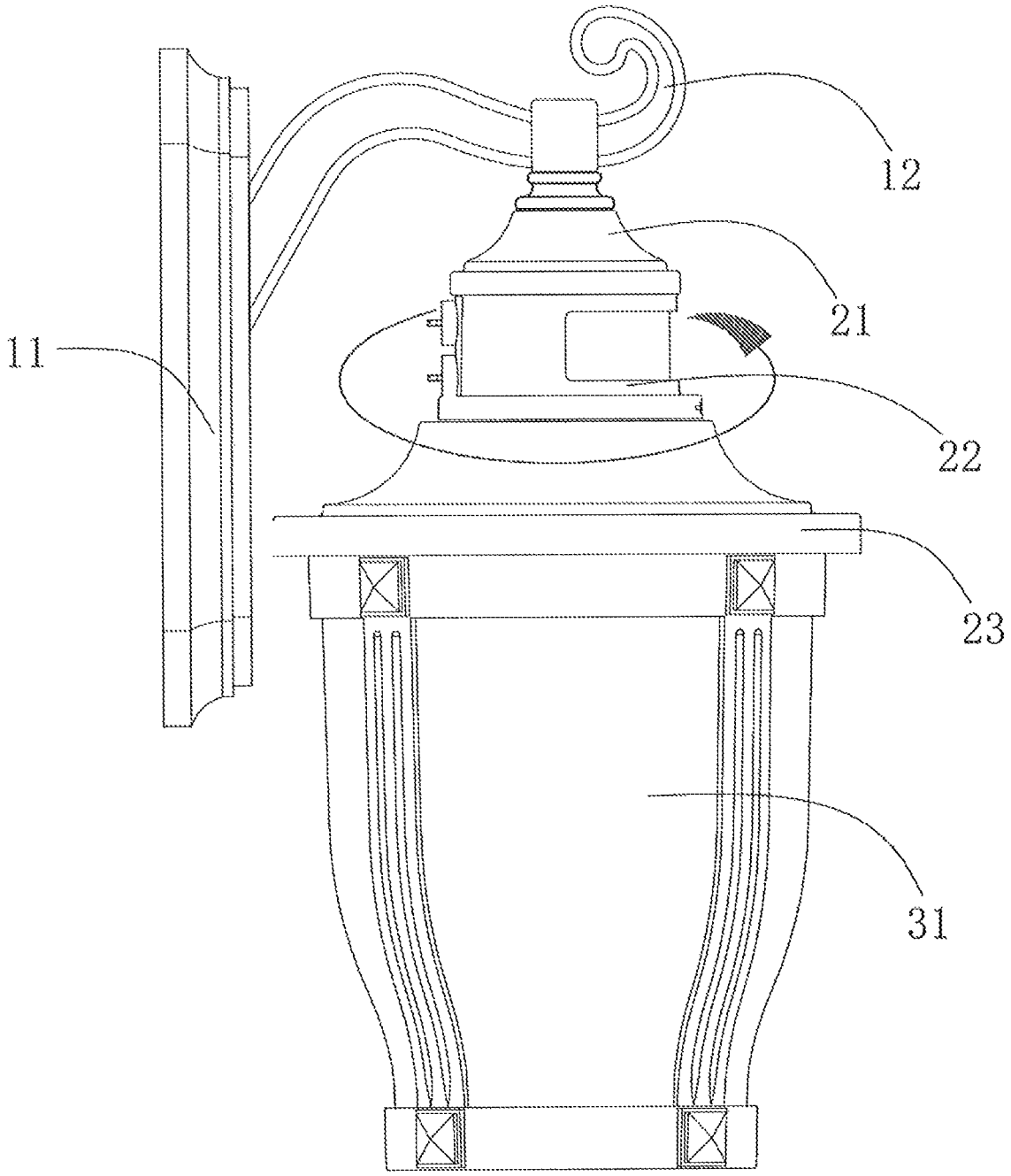
FIG. 3 is a schematic structural diagram illustrating a courtyard sensor lamp according to an embodiment of the present disclosure, before an upper cover and a lower cover are rotated.
Figure 4:
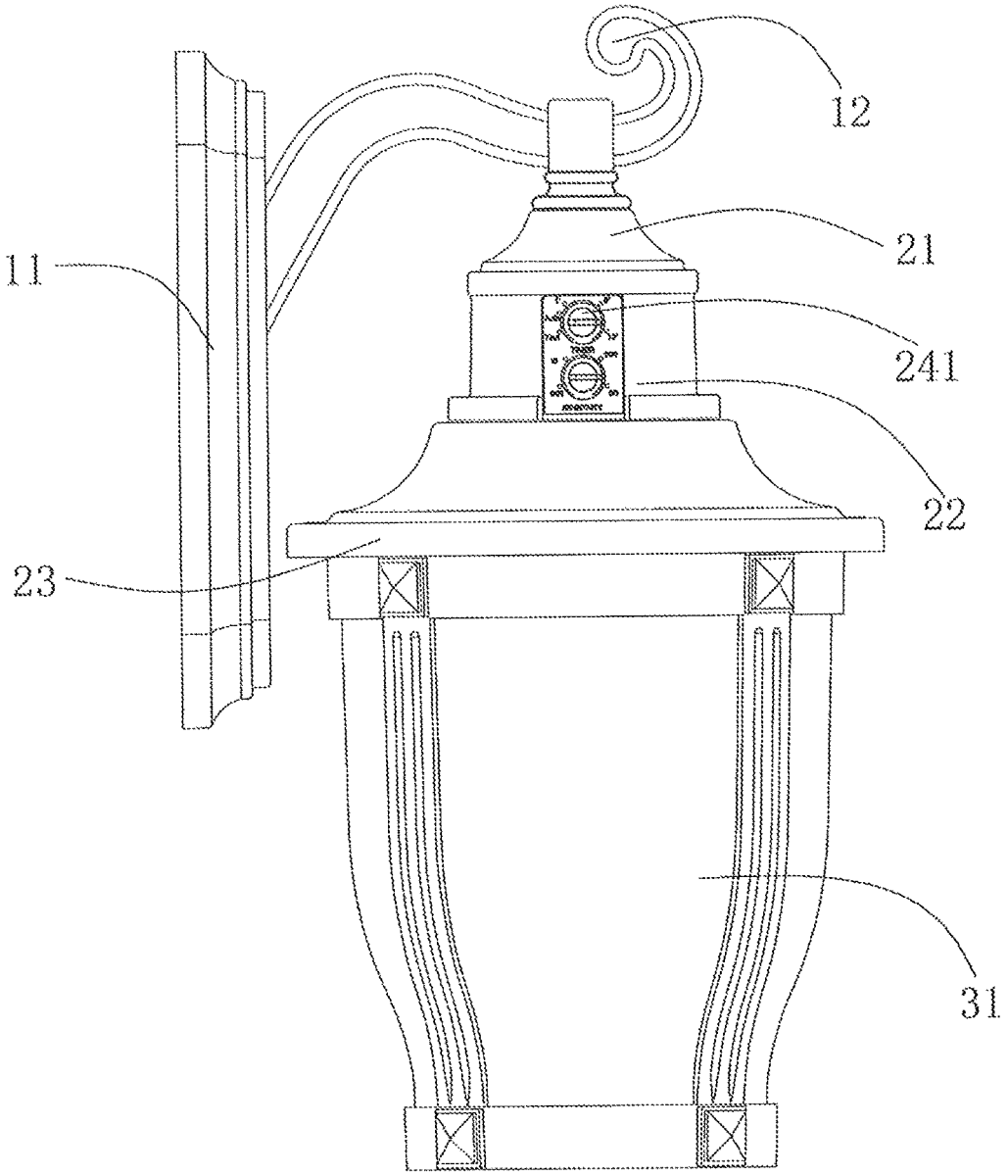
FIG. 4 is a schematic structural diagram illustrating a courtyard sensor lamp according to an embodiment of the present disclosure, after the upper cover and the lower cover has been rotated.
Figure 5:
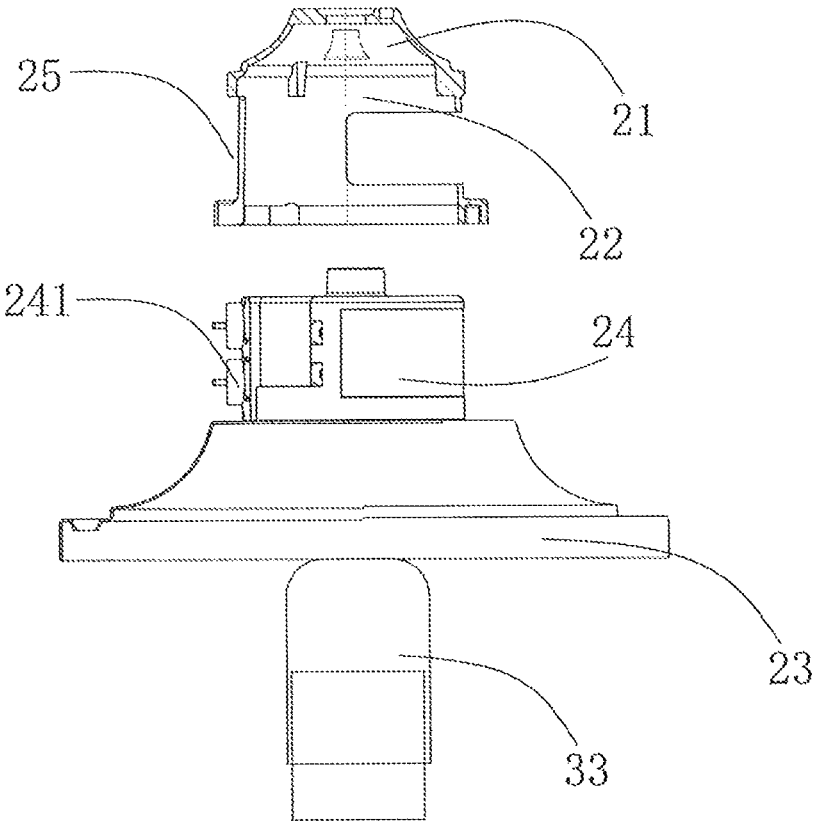
FIG. 5 is a schematic structural diagram illustrating a courtyard sensor lamp according to an embodiment of the present disclosure, with an upper cover connected to a connecting portion.

As shown in FIG. 3 and FIG. 4, the cover is fixedly suspended from the hanging end 12, and the cover includes an upper cover 21 and a lower cover 23 rotatably connected to the upper cover 21 by axial rotation, and an angle of axial rotation between the upper cover 21 and the lower cover 23 is 90°. FIG. 3 is a schematic diagram before rotation, and FIG. 4 is a schematic diagram after the angle of axial rotation reaching 90°. The cover further includes a connecting portion 22 fixedly connected to the upper cover 21, and a switch module 24. The lower portion of the connecting portion 22 is provided with a concave step, and the lower cover 23 or the switch module 24 fixed on the lower cover 23 is provided with a boss that cooperates with the step. As shown in FIG. 5, the switch module 24 is fixed to the upper portion of the lower cover 23 and disposed in the connecting portion 22. When the lower cover 23 is rotated, the switch module 24 is simultaneously rotated. The connecting portion 22 is provided with a through hole 25 corresponding to the switch module 24. The switch module 24 includes an infrared sensor and a switch knob 241 that are electrically connected to each other. According to the configuration of the switch module 24, the through hole 25 in this embodiment has a long groove shape formed along the rotation angle. The through hole 25 is also the rotation track of the switch module 24. A sealing element is disposed between the upper cover, the connecting portion and the lower cover. The sealing element is a silicone seal.

In this embodiment, the switch module 24 is an integrated lamp sensor and sensor switch control module, and the switch module is controllable by rotation between the upper cover 21 and the lower cover 24. During an operating mode, the lamp sensor faces forward the front of the courtyard sensor lamp. By rotating the upper cover or the lower cover, a control button on the back of the lamp sensor can be showed. When adjustment of the lamp sensor is finished, the lamp sensor is rotated back to an original position, and then the courtyard sensor lamp can operates normally.

In this embodiment, the lower cover 23 is movably connected to the connecting portion 22 by an engaging manner, and the switch module 24 disposed in the lower cover 23 is simultaneously covered and hidden by the connecting portion 22 to prevent the switch module 24 from being exposed to the outside environment and being irradiated by sunlight or being eroded by wind or rain. By rotating the switch module 24 to the corresponding through hole 25 of the connecting portion 22, the switch control of the courtyard sensor lamp can be implemented, which is easy to operate.

In the embodiment, the connecting portion 22 is fixedly connected to the upper cover 21, and the connecting portion 22 is provided with a through hole 25. When the switch module 24 rotates with the lower cover 23 to the use position, the switch module 24 is exposed at the through hole 25. The through hole 25 is used for the switch module 24 to communicate with the outside, which is convenient for the user to operate. When the switch module 24 is rotated to the hidden position, the switch module 24 is hidden by the connecting portion 22 to achieve an aesthetically pleasing appearance, and also prevents the switch module 24 from being exposed to outside environment and being irradiated by sunlight or being eroded by wind or rain.

The lampshade 31 is fixed below the lower cover 23, and the light source 32 is disposed in the lampshade 31. The light source 32 is electrically connected to the switch module 24. The lampshade 31 can be a glass lampshade 31 or a plastic lampshade 31 with good optical transparency, and the light source 32 can be an incandescent lamp or an LED lamp. The light source 32 is fixed inside the lampshade 31 at an upper part of the lampshade 31 by a ceramic lamp holder 33. The ceramic lamp cap 33 and the switch module 24 are connected to each other, and the switch module 24 is connected to an electric supply.

During implementation, the electric supply can supply electric power to the switch module 24, and the user can select an infrared sensor switch or a manual switch according to the switch module 24. After the switch is activated, the electric power is sent to the light source 32 fixedly connected to the ceramic lamp holder 33 through the wire, and light source 32 is turned on.

Figure 6:
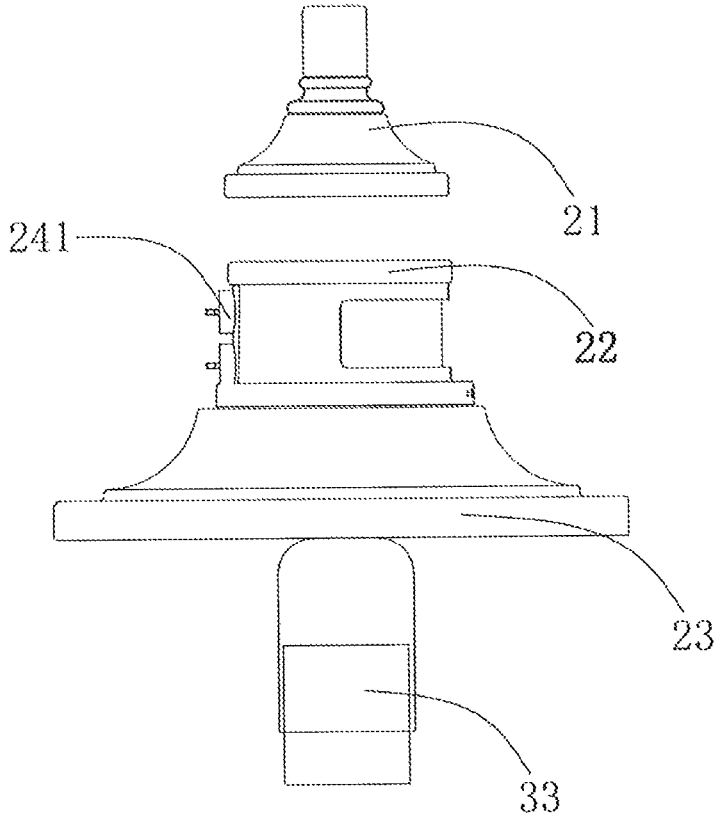
FIG. 6 is a schematic structural diagram illustrating a courtyard sensor lamp according to an embodiment of the present disclosure, with a lower cover connected to a connecting portion.
Figure 7:
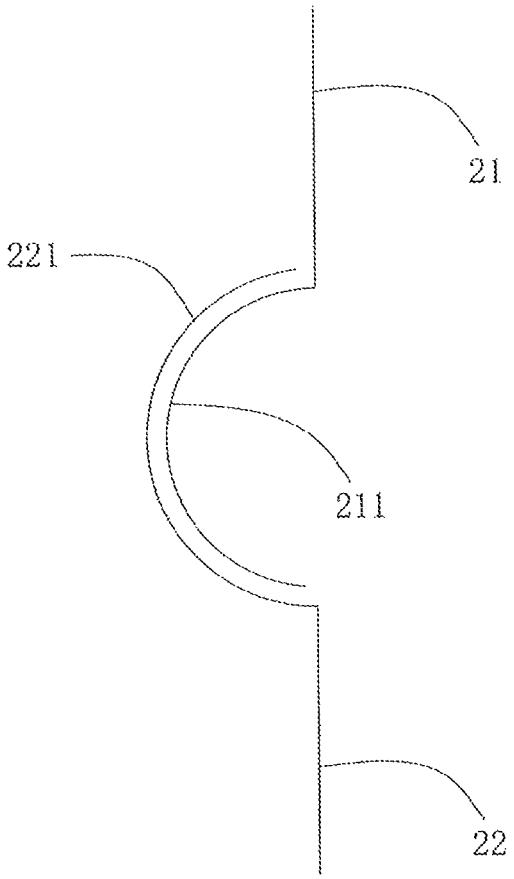
FIG. 7 is a schematic structural diagram illustrating an undulating protrusion and a groove of a courtyard sensor lamp which cooperate with each other according to an embodiment of the present disclosure.

In another embodiment, as shown in FIG. 6 and FIG. 7, the connecting portion 22 and the lower cover 23 are fixed to each other, and the switch module 24 is exposed at the through hole 25. The lower portion of the upper cover 21 is provided with an annular undulating protrusion 211, and an upper portion of the connecting portion 22 is provided with a groove 221 which is engaged with the undulating protrusion 211. The groove 221 is an annular groove 221 cooperating with the annular undulating protrusions 211. An interference fit is formed between the undulating protrusion 211 and the groove 221. There are at least two undulating protrusions 211 and at least two grooves 221 engaged with the at least two undulating protrusions 211 respectively. During implementation, the undulating protrusion 211 rotates in an annular shape along the groove 221, thereby rotating the upper cover 21 and the lower cover 23 to each other. The switch module 24 fixed to the connecting portion 22 is rotated to the use position or the hidden position accordingly. In this embodiment, the use position may be a side of the courtyard sensor lamp that often faces the user. For example, the courtyard sensor lamp is provided on the side of the road through which the pedestrian passes in the courtyard, and the use position is the side of the courtyard sensor lamp facing the road, and the hidden position is the side of the courtyard sensor lamp facing away from the road. When the courtyard sensor lamp is not required to be operated, the upper cover 21 is rotated relative to the lower cover 23, so that the switch module 24 faces away from the road, and the switch module 24 is not observed by the pedestrian. When the courtyard sensor lamp needs to be operated, the upper cover 21 can be rotated relative to the lower cover 23 so that the switch module 24 faces the side of the road to facilitate the operation of the courtyard sensor lamp.

The cooperation between the projection and the groove further prevents the upper cover 21 and the lower cover 23 from falling off during rotation. The plurality of undulating protrusions 211 make the structure more compact, and the upper cover 21 and the lower cover 23 are more stable when rotated.

The technical features of the above-described embodiments may be combined in any combination. For the sake of brevity of description, all possible combinations of the technical features in the above embodiments are not described. However, as long as there is no contradiction between the combinations of these technical features, all should be considered as the scope of the specification.

The above-described embodiments are merely illustrative of several embodiments of the present disclosure, and the description thereof is more specific and detailed, but is not to be construed as limiting the scope of the disclosure. It should be noted that a number of variations and modifications may be made by the skilled person in the art without departing from the spirit and scope of the disclosure. Therefore, the scope of the disclosure should be determined by the appended claims.

What is claimed is:

1. A courtyard sensor lamp, comprising:

an arm having a fixed end and a hanging end connected to each other;

a cover, comprising an upper cover, a lower cover, a connecting portion and a switch module, wherein the upper cover is fixedly connected to the hanging end, the connecting portion is rotatably connected to the lower cover, the connecting portion and the upper cover are fixed to each other, the switch module is fixed to the upper portion of the lower cover and disposed in the connecting portion, a peripheral wall of the connecting portion is provided with a through hole corresponding to a control button of the switch module, and the through hole has a long groove shape formed along the rotation angle;

a light source electrically connected to the switch module; and a lampshade fixed below the lower cover and covering the light source.

2. The courtyard sensor lamp according to claim 1, wherein a lower portion of the upper cover is provided with an undulating, protrusion, and an upper portion of the connecting portion is provided with a groove engaged with the undulating protrusion.

3. The courtyard sensor lamp according to claim 2, wherein there are at least two undulating projections and at least two grooves engaged with the at least two undulating projections respectively.

4. The courtyard sensor lamp according to claim 1, wherein a lower portion of the connecting portion is provided with a concave step, and the lower cover or the switch module fixed on the lower cover is provided with a boss cooperating with the step.

5. The courtyard sensor lamp according to claim 1, wherein a rotation angle between the upper cover and the lower cover is $75° \leq \alpha \leq 175°$.

6. The courtyard sensor lamp according to claim 1, wherein the light source is an incandescent lamp or an LED lamp.

7. The courtyard sensor lamp according to claim 1, wherein the light source is fixed inside the lampshade at an upper part of the lampshade by a ceramic lamp holder.

8. The courtyard sensor lamp of claim 1, wherein the switch module comprises an infrared sensor and a switch knob electrically connected to each other.

9. The courtyard sensor lamp according to claim 1, wherein a sealing element is disposed between the upper cover, the connecting portion and the lower cover.

* * * * *